US005593026A

United States Patent [19]

Broskow

[11] Patent Number: 5,593,026

[45] Date of Patent: Jan. 14, 1997

[54] RING CONTAINER MULTIPACK WITH PERFORATED TEAR STRIP FOR CONTAINER REMOVAL

[75] Inventor: James A. Broskow, Buffalo Grove, Ill.

[73] Assignee: Illinois Tool Works Inc., Glenview, Ill.

[21] Appl. No.: 391,137

[22] Filed: Feb. 21, 1995

[51] Int. Cl.[6] ..... B65D 71/50

[52] U.S. Cl. ..... 206/150; 206/151; 294/87.2

[58] Field of Search ..... 294/87.2; 206/150, 206/151, 427

[56] References Cited

U.S. PATENT DOCUMENTS

| | | | |
|---|---|---|---|
| 2,650,128 | 8/1953 | Failor . | |
| 2,680,038 | 6/1954 | Gray . | |
| 2,719,100 | 9/1955 | Banigan . | |
| 2,874,835 | 2/1959 | Poupitch . | |
| 2,994,426 | 8/1961 | Biesecker et al. . | |
| 2,997,169 | 8/1961 | Poupitch | 206/150 |
| 3,038,602 | 6/1962 | Rapata . | |
| 3,191,849 | 6/1965 | Gutowski . | |
| 3,204,386 | 9/1965 | Creed et al. . | |
| 3,307,321 | 3/1967 | Beart . | |
| 3,314,591 | 4/1967 | Cheeley . | |
| 3,348,674 | 10/1967 | Poupitch | 294/87.2 X |
| 3,383,827 | 5/1968 | Schaich . | |
| 3,608,949 | 9/1971 | Owen . | |
| 3,738,698 | 6/1973 | Helms . | |
| 3,744,704 | 7/1973 | Struble . | |
| 3,868,140 | 2/1975 | Gordon . | |
| 4,250,682 | 2/1981 | Braun . | |
| 4,919,260 | 4/1990 | Cunningham . | |
| 5,098,144 | 3/1992 | Marvin | 294/87.2 |
| 5,174,441 | 12/1992 | Marco . | |

*Primary Examiner*—Bryon P. Gehman

*Attorney, Agent, or Firm*—Trexler, Bushnell, Giangiorgi & Blackstone, Ltd.

[57] ABSTRACT

A novel carrier for carrying a plurality of containers, such as bottles, cans and the like, includes novel tear strips which can be separated from the carrier so that the containers held by the carrier can be easily removed from the carrier. The carrier includes container engaging portions, each of which includes bands which define apertures therein for engaging the side walls of the containers to hold the containers therein to form a package. Each band has an inner margin portion, an outer margin portion and side margin portions. Each tear strip is positioned on the outer margin portions of the bands. The strip is separated from the remainder of the carrier by a linear perforation line along which the strip can be torn. Once the strip is torn, a narrow, continuous web remains along the length of the carrier to maintain the containers in the package array. The web may be selectively ruptured by leveraging a container against an adjacent container.

10 Claims, 1 Drawing Sheet

RING CONTAINER MULTIPACK WITH PERFORATED TEAR STRIP FOR CONTAINER REMOVAL

BACKGROUND OF THE INVENTION

This invention is generally directed to a novel carrier which is used to secure containers together to form a package. More particularly, the invention contemplates a carrier which secures containers, such as bottles or the like, together into a package and from which the containers are easily removed.

Currently, several types of carriers can be found in the art for securing containers together into a package. Some of these carrier provide quick release means for allowing a consumer to quickly and easily release the containers from the carrier.

One such carrier can be found in U.S. Pat. No. 3,038,602 which discloses a container carrier that holds six cans in a package array. The carrier is positioned near the top of each can. A zipper strip is provided on the carrier and is positioned between the rows of cans. A consumer releases the cans from the carrier by tearing the zipper strip. When the zipper strip is torn, the carrier creates two sets of packages, each consisting of three cans.

One problem which arises with this type of quick release carrier is that when the zipper strip is torn, two separate packages are formed which may be undesirable for handling the cans.

Another such carrier can be found in U.S. Pat. No. 5,174,441 which discloses a tear-open container carrier that holds a plurality of cans in a package. Each can is held within a container encircling band. Tear strips are provided on the carrier exterior to the container encircling bands. A consumer releases the cans from the carrier by tearing the tear strips. The removal of the strip ruptures each individual band.

One problem which arises with this type of quick release carrier is that when the tear strips are torn, each band in the carrier is ruptured which can lead to the cans being uncontrollably dislodged from the carrier.

The present invention presents a quick release carrier which overcomes or minimizes the problems presented by the prior art and presents several other novel advantages and features.

OBJECTS AND SUMMARY OF THE INVENTION

A general object of the present invention is to provide a novel plastic carrier for carrying a plurality of containers, such as bottles, cans or the like, which includes novel tear strips which allow a consumer to easily and quickly remove containers from the carrier.

An object of the present invention is to provide a carrier which has novel tear strips which can be detached from the remainder of the carrier while maintaining the containers in a package to prevent the containers from becoming uncontrollably dislodged from the carrier.

A further object of the present invention is to provide a carrier which is sturdy while allowing containers to be easily and quickly released from the carrier.

Briefly, and in accordance with the foregoing, the present invention discloses a novel carrier for carrying a plurality of containers, such as bottles, cans and the like, which includes novel tear strips which can be separated from the carrier so that the containers held by the carrier can thereafter be easily and quickly removed from the carrier. The carrier includes container engaging portions, each of which includes annular rings or bands which define apertures therein for engaging the side walls of the containers to hold the containers therein to form a package. The outer margins of the apertures are contoured.

Each ring or band has an inner margin portion, an outer margin portion and side margin portions. The inner margin portions of adjacent bands are joined together and side margin portions of adjacent bands are joined together. Each tear strip is positioned on the outer margin portions of the bands. The strip is separated from the remainder of the carrier by a generally linear perforation line along which the strip can be torn. Once the strip is torn, a narrow, continuous web remains along the length of the carrier to maintain the containers in a package array. The web is selectively ruptured and may be ruptured by leveraging a container against an adjacent container.

The perforation line is formed from a series of spaced dots, dashes or the like. A continuous portion of the carrier is provided between each dot or dash. Each tear strip has a width which is greater than the distance between two adjacent dots or dashes.

Each perforation line starts at an end of the carrier and ends in a region that is spaced inwardly from the side margin of the last aperture on the opposite side of the carrier. The perforation line ends in a region within the perimeter of the carrier such that when the strip is separated from the remainder of the carrier, the strip remains attached to the carrier at an end of the strip.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
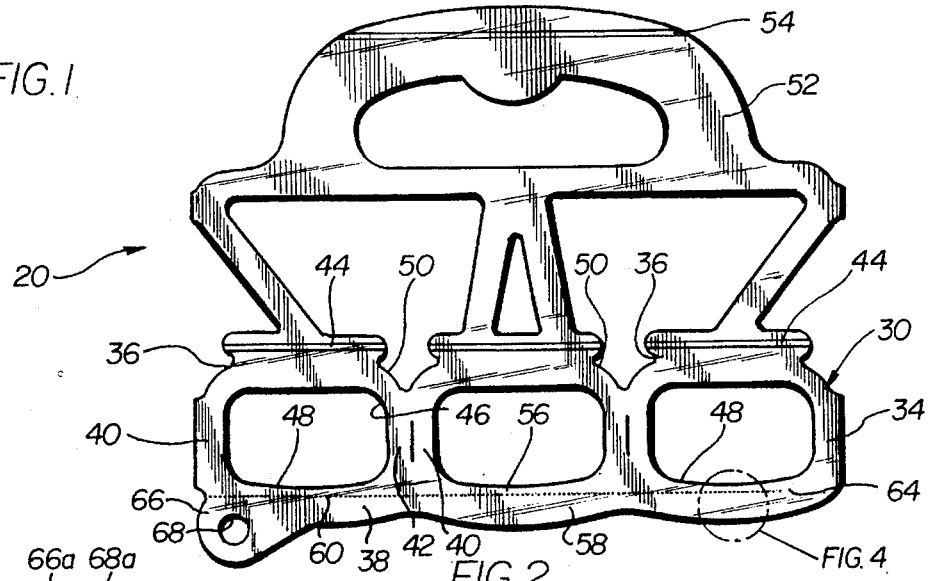
FIG. 1 is a side elevational view of a carrier which incorporates the features of a first embodiment of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
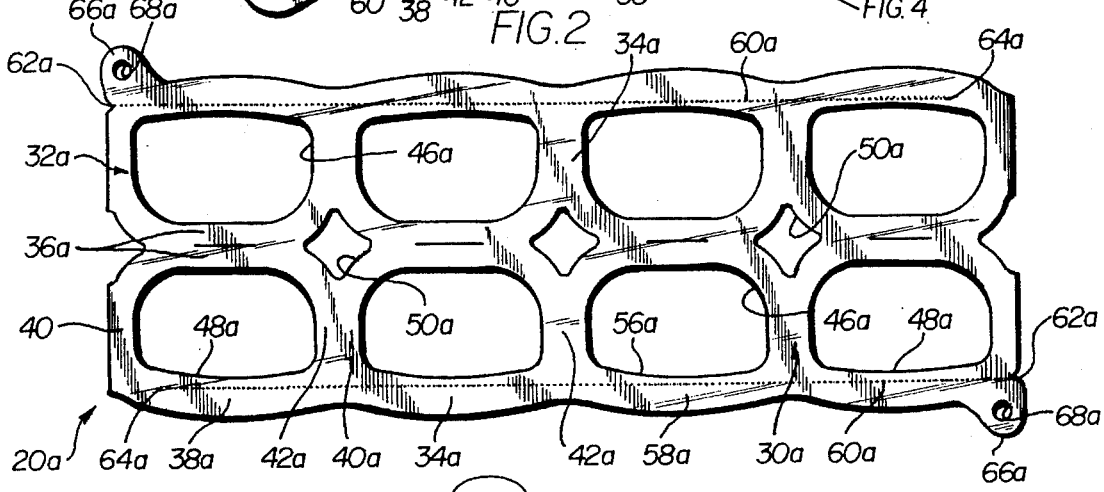
FIG. 2 is a top elevational view of a carrier which incorporates the features of a second embodiment of the invention.

As shown in the drawings, a multi-packaging device or carrier device 20, 20*a*, constructed according to the teachings of the present invention, is shown holding a plurality of containers 22. A first embodiment of the carrier 20 is shown in FIG. 1 and a second embodiment of the carrier 20*a* is shown in FIG. 2. Like elements in each embodiment are denoted by like reference numerals with the like elements of the second embodiment having the suffix "a" thereafter.

Figure 3:
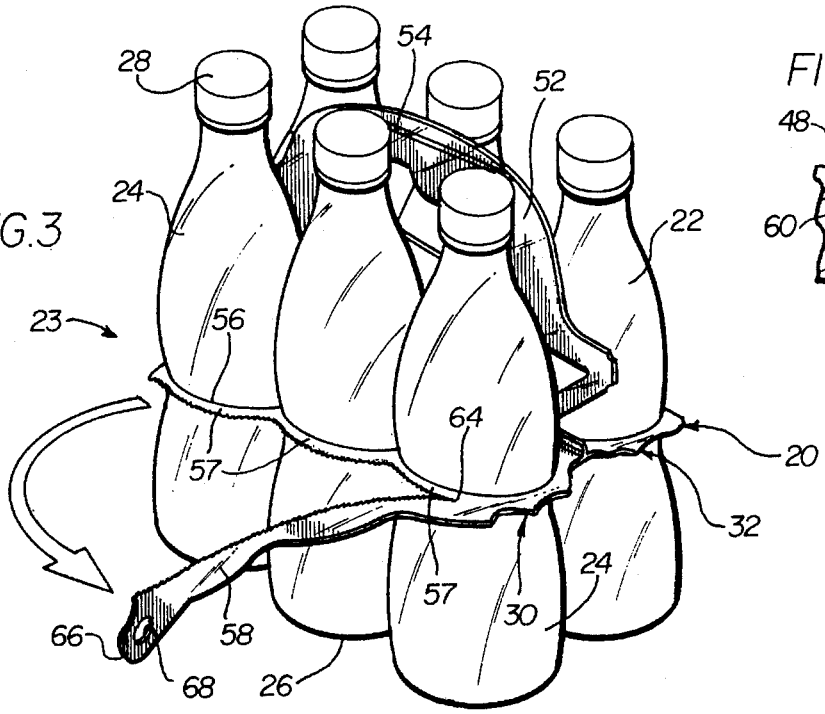
FIG. 3 is a perspective view of the carrier of FIG. 1 shown surrounding a plurality of containers to form a package.

As shown in FIG. 3, the carrier device 20, constructed in accordance with the teachings of the present invention, is used to carry six bottles 22 to form a package 23. Of course, the carrier device 20 of FIG. 2 is employed in a like manner to form a package. Each bottle 22 includes a side wall 24, a bottom wall 26 and a top or cap 28. It is to be understood that other types of containers can be carried by the carrier 20, 20*a*, such as cans and the like.

The general structure of the first embodiment of the multi-package device or carrier device 20 shown in FIG. 1 and the method for forming the same is disclosed in U.S. patent application Ser. No. 08/230,308 entitled "Container Carrier" and owned by the assignee herein and which disclosure is incorporated herein by reference. The general structure of the second embodiment of the multi-package device or carrier 20*a* shown in FIG. 2 is a carrier 20*a* formed from a substantially planar blank or sheet by suitable known means.

Each carrier 20, 20*a* is made of a suitable flexible, resilient, stretchable material, such as plastic. Preferably, the carrier 20, 20*a* is made of a low density polyethylene so that the carrier 20, 20*a* can be stretched over the containers 22 and conform to the side walls 24 of the containers 22. The carrier 20, 20*a* may be applied to the containers 22 by known means, for example, by the machines disclosed in U.S. Pat. No. 4,250,682 to Braun or U.S. Pat. No. 3,204,386 to Creed et al.

When the containers 22 are secured in a package arrangement by the carrier 20, 20*a*, the containers 22 are aligned in an array so to form two rows. As shown, each row has three bottles. It is to be understood that the carrier 20, 20*a* operates equally well with any number of containers.

Directing attention to the general structure of the first embodiment of the carrier 20 shown in FIG. 1, the carrier 20 includes container engaging portions 30, 32, each formed from a plurality of annular rings or bands 34. Each band 34 has an inner margin 36, an outer margin 38 and side margins 40, 42 which connect the inner margin 36 of each band 34 to the outer margin 38 of the same band 34. The side margins of adjacent bands 34 are integrally joined together so that the outer margins 38 of the bands 34 are continuous and uninterrupted along the length of the carrier 20.

The bands 34 are connected or joined together by a seam or a joined portion 44, as described herein, along the inner margins 36 of each band 34. The annular bands 34 define a plurality of shaped apertures 46 for securely holding the containers 22 therein as shown in FIG. 3. The outer margin 48 of each aperture 46 is slightly contoured for reasons described herein.

The container engaging portions 30, 32 freely extend from the joined portion 44. The joined portion 44 projects generally perpendicular to the plane of the container engaging portions 30, 32 when the carrier 20 is assembled with containers 22.

The joined portion 44 is formed by extruding a strip or layer of resilient, stretchable material, such as plastic, preferably low density polyethylene material, between the inner margins 36 of each annular band 34 and thereafter sufficiently melting and merging the inner margins 36 of the container engaging portions 22, 24 and the layer of extruded plastic together by known means, preferably by heat sealing and fusing the layers together, to form a strong, integral bond. The joined portion 44 is interrupted along its length by cutouts 50 which form apertures between the container engaging portions 30, 32.

Preferably, the carrier 20 is formed by joining two separate sheets of plastic material together at the joined portion 44. However, it is within the scope of the invention that a single sheet of plastic material may be used to form the carrier 20 by folding the sheet in half and applying a layer of plastic or otherwise fusing the sheets together to form the joined portion 44.

The carrier 20 includes a handle portion 52 which extends upwardly from the joined portion 44 of the carrier 20. The handle portion 52 includes two sides portions which are formed from the two sheets that are used to form the carrier 20. A bond 54, formed by heat sealing or by extruding a layer of plastic material between the side portion, is provided along an upper portion of the handle portion 52 to prevent the side portions of the handle portion 52 from separating thereby making the handle portion 52 easy to grasp by a consumer. Alternatively, the carrier device 20 can be constructed without a handle portion.

Now directing attention to the general structure of the second embodiment of the carrier 20*a* shown in FIG. 2, the carrier 20*a* is formed from a substantially planar blank or sheet having container engaging portions 30*a*, 32*a*, each formed from a plurality of annular rings or bands 34*a*. Each band 34*a* has an inner margin 36*a*, an outer margin 38*a* and side margins 40*a*, 42*a* which connect the inner margin 36*a* of each band 34*a* to the outer margin 38*a* of the same band 34*a*. The inner margins of adjacent bands 34*a* are integrally joined together. The side margins of adjacent bands 34*a* are integrally joined together so that the outer margins 38*a* of the bands 34*a* are continuous and uninterrupted along the length of the carrier 20*a*.

The annular bands 34*a* define a plurality of shaped apertures 46*a* for securely holding containers therein. The outer margin 48*a* of each aperture 46*a* is slightly contoured for reasons described herein. The integrally joined inner margins 36*a* are interrupted by cutouts 50*a* which form apertures between the container engaging portions 30*a*, 32*a*. A consumer can easily grasp the package by inserting his or her fingers into the apertures 50*a*.

Now directing attention to the specifics of the features of the present invention, each carrier device 20, 20*a* includes novel tear strips 58, 58*a*. For clarity in the description of the tear strips 58, 58*a*, the tear strips of the present invention are described in reference to the embodiment of the multipackaging device or carrier device 20 shown in FIG. 1. The differences between the tear strips 58 of the first embodiment and the tear strips 58*a* of the second embodiment are noted herein.

The continuous outer margins 38 of the bands 34 on each side of the carrier device 20 are separated into a first portion 56 and a second portion 58 by a fine, linear perforation line 60 for reasons described herein. The second portion 58 forms a tear strip on each side of the rows of containers 22 along the continuous outer margins 48 of the bands 34. Each tear strip 58 is formed from a substantial portion of the continuous outer margins 48 of the bands 34. The strips 58, once separated from the remainder of the carrier 20, allow the containers 22 to be easily and quickly released from the carrier 20.

Figure 4:
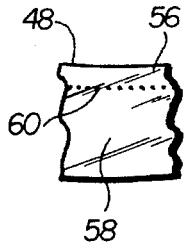
FIG. 4 is an enlarged view of a portion of the carrier shown as indicated in FIG. 1.

The perforation line 60 which separates the tear strip or second portion 58 from the first portion 56 may be formed from a series of spaced dots, as shown in FIG. 4, or, alternatively, a series of spaced short lines. Each dot in the perforation line 60 is separated from each other by a continuous, uninterrupted portion of the carrier 20. The perforation lines 60 do not significantly reduce package integrity while facilitating tearing and removal of the tear strips 58 on each side of the carrier device 20. It is envisioned that an extruded bead of material could be used instead of the perforation line. The perforation line 60 is formed by suitable known means.

Each perforation line 60 starts at an end 62 of the carrier device 20 and preferably ends at point 64 which is within the perimeter of the carrier device 20 so that the strip 58 is integrally joined with the remaining portion of the carrier device 58 at point 64. The tear strips 58 used in the first embodiment of the carrier device 20, as shown in FIGS. 1 and 3, both start at the same end of the carrier device 20. The tear strips 58*a* used in the second embodiment of the carrier device 20*a*, as shown in FIG. 2, start at opposite ends of the carrier device 20*a*. While these configurations are shown in the drawings, the first embodiment of the carrier device 20 may have the perforation lines 60 starting at opposite ends and the second embodiment of the carrier device 20*a* may have the perforation lines 60*a* starting at the same end.

When each strip 58 is torn along its perforation line 60, the strip 58 remains attached to the carrier device 20 at point 64 and does not separate into a distinct, discardable device from the remainder of the carrier device 20. Each perforation line 60 also ends at point 64 which is spaced inwardly from the end margin of the last aperture on each side of the carrier device 20 for reasons described herein.

The perforation lines 60 allow a consumer to tear the tear strips 58 to separate the strips 58 from its associated first portion 56. Once each strip 58 is separated from its associated first portion 56, as shown in FIG. 3, a very narrow, continuous web of material, which is formed from the first portion 56, remains and is not torn or ruptured by the tearing of the strip 58. The containers 22 are retained in the package array by the narrow web 56 so as to not separate from each other. The narrow, continuous web 56 prevents the containers 22 from becoming dislodged uncontrollably when the consumer wants to open the package 23. The tearing action of the strip 58 from the remaining portion of the carrier device 20 may form a jagged edge along the length of the web 56. Preferably, as shown in FIG. 4, the width of the first portion 56, which later forms the narrow web after the tear strip 58 is torn, is greater than the distance between two adjacent dots or lines in the perforation line 60, so that the strip 58 may be removed with a minimal chance of the forces of removing the strip 58 being directed into the apertures 46 of the carrier device 20 prematurely.

To release the containers 22 from the carrier device 20, the narrow web 56 is selectively ruptured. Since the carrier device 20 is positioned along the side walls 24 of each of the bottles 22, the web 56 may be selectively and easily ruptured through a leveraging of the bottles 22 against adjacent bottles 22 to break the remaining narrow web 56 which holds the bottles 22 together in the package array.

Since the outer margins 48 of the apertures 36 in the carrier device 20 are slightly contoured and each tear strip 58 is linear, this creates a region 57 of specific reduced width of the remaining web 56, and therefore a stress concentration and weakness to facilitate the easy rupturing of the web 56 and removal of the containers 22 thereafter. Furthermore, since each perforation line 60 ends at point 64 which is spaced inwardly from the end margin of the last aperture 46, depending on the amount of force used to tear the strip 58, the final forces of the tearing of the strip 58 may be directed inwardly into the aperture 46 which releases the container 22 in that aperture 46 while retaining the containers in all other apertures.

As shown in the drawings, each tear strip 58, 58*a* may include an enlarged portion 66, 66*a* at its starting end with an aperture 68, 68*a* therein. To tear the strip 58, 58*a*, the consumer grasps the enlarged portion 66, 66*a* of the strip 58, 58*a* and may place a finger through the aperture 68, 68*a* in the enlarged portion 66, 66*a* to facilitate gripping of the tear strip 58, 58*a* so that the strip 58, 58*a* can be easily torn.

The carrier devices 20, 20*a* of the present invention presents several other advantages. For example, the carrier devices 20, 20*a* are sturdy while allowing a consumer to easily and quickly remove the containers 22. The carriers devices 20, 20*a* of the present invention can be manufactured at a low cost.

While preferred embodiments of the present invention are shown and described, it is envisioned that those skilled in the art may devise various modifications of the present invention without departing from the spirit and scope of the appended claims.

The invention claimed is:

1. A planar sheet material carrier for carrying a plurality of containers comprising: a container engaging portion comprising a row of a plurality of continuous annular bands defining a plurality of spaced apart apertures through said bands for holding containers therein, each of said bands having an inner margin portion, an outer margin portion and opposite side margin portions between said inner and outer margin portions, said outer margin portions of adjacent bands in said row being joined together and said side margin portions of adjacent bands in said row being joined together; each of said outer margin portions of said bands having a first portion, a second portion and separating means between said first and second portions for selectively separating the second portion of the outer margin portions from the first portions of the outer margin portions, said first portions of the outer margin portions being continuous after predetermined ones of said second portions have been separated from said first portions of said outer margin portions for retaining containers in said respective annular bands when containers are assembled with the carrier.

2. A carrier as defined in claim 1, wherein after said predetermined ones of said second portions are separated from said first portions, said first portions form a narrow, continuous web.

3. A carrier as defined in claim 1, wherein said separating means is a perforation line.

4. A carrier as defined in claim 3, wherein outer margins of each aperture are contoured and said perforation line is linear.

5. A carrier as defined in claim 3, wherein said perforation line ends in a region within the perimeter of the carrier such that when all of said second portions are separated from said first portions, said second portions remain attached to the first portions at an end of the second portions.

6. A carrier as defined in claim 3, wherein said perforation line starts at one end of the carrier and ends in a region that is spaced inwardly from an outer side margin of a last aperture at an end of the carrier opposite from said one end.

7. A carrier as defined in claim 3, wherein said perforation line is a series of dots spaced apart from each other a predetermined distance, and each said first portion of each said outer margin portion has a width which is greater than the distance between two adjacent dots.

8. A package comprising: a carrier and a plurality of containers having side walls, said carrier comprising side by side container engaging portions, each container engaging portion comprising a plurality of bands defining spaced apart apertures through said bands, said bands engaging the side walls of the containers to hold the containers therein, each of said bands having an inner margin portion, an outer margin portion and side margin portions between said inner and outer margin portions, said inner margin portions of adjacent bands of each container engaging portion being joined together and to adjacent inner bands of the other of said container engaging portions, and said side margin portions of adjacent bands being joined together; said outer margin portions of said bands on each of said container engaging portions having a first portion, a second portion and a perforation line between said first and second portions for selectively separating predetermined ones of said second portions of said outer margin portions from the first portions of the outer margin portions, said first portions of the outer margin portion forming a narrow, continuous web along the carrier after said predetermined ones of said second portions have been separated from said first portions of said outer margin portions to maintain said containers in said package, said narrow, continuous web being selectively rupturable through leveraging said containers against adjacent containers.

9. A package as defined in claim 8, wherein outer margins of each aperture are contoured.

10. A package as defined in claim 8, wherein outer margins of each aperture and said perforation line approach and recede from each other to provide regions of weakness for facilitating rupturing of said web at said regions.

* * * * *